US009566602B2

(12) United States Patent
MacCormick

(10) Patent No.: US 9,566,602 B2
(45) Date of Patent: Feb. 14, 2017

(54) STAIN AND PAINTING TOOL

(76) Inventor: Anna MacCormick, Minnetonka, MN (US)

( * ) Notice: Subject to any disclaimer, the term of this patent is extended or adjusted under 35 U.S.C. 154(b) by 1907 days.

(21) Appl. No.: 12/284,785

(22) Filed: Sep. 25, 2008

(65) Prior Publication Data

US 2009/0100624 A1 Apr. 23, 2009

Related U.S. Application Data

(60) Provisional application No. 60/999,375, filed on Oct. 18, 2007.

(51) Int. Cl.
*B05C 17/00* (2006.01)
*A46B 9/02* (2006.01)

(52) U.S. Cl.
CPC ..... *B05C 17/00* (2013.01); *A46B 9/02* (2013.01); *A46B 2200/202* (2013.01)

(58) Field of Classification Search
CPC ..... A46B 9/02; A46B 2200/202; B05C 17/00
USPC ..... 15/104.93, 104.94, 209.1, 210.1, 223, 15/236.03, 244.3, 245.1; 401/266; 427/429
See application file for complete search history.

(56) References Cited

U.S. PATENT DOCUMENTS 3,079,628 A * 3/1963 Wright ..... 401/204
3,105,263 A * 10/1963 Ginter ..... 15/244.1
3,134,124 A * 5/1964 Horn ..... 15/244.1
3,605,165 A * 9/1971 Burns ..... 15/210.1
4,300,258 A * 11/1981 Burns et al. ..... 15/210.1
4,499,627 A * 2/1985 Gruns ..... 15/210.1
4,856,136 A * 8/1989 Janssen ..... 15/244.3
4,919,604 A * 4/1990 Wilson ..... 425/458
5,010,615 A * 4/1991 Carter ..... 15/104.94
5,146,646 A * 9/1992 Langford et al. ..... 15/210.1
5,267,369 A * 12/1993 O'Neil et al. ..... 15/210.1
5,293,662 A * 3/1994 Newman et al. ..... 15/210.1
5,560,067 A * 10/1996 Brook ..... 15/104.94
5,920,943 A * 7/1999 Barker ..... 15/143.1
5,933,905 A * 8/1999 Hess ..... 15/160
6,311,361 B1 * 11/2001 Cole ..... 15/227
6,536,978 B2 * 3/2003 Lowery ..... 401/266
6,901,622 B2 * 6/2005 Thompson et al. ..... 15/104.002
7,788,760 B2 * 9/2010 Schneble ..... 15/236.07
2003/0005536 A1 * 1/2003 Kim ..... 15/210.1
2004/0158949 A1 * 8/2004 Booth et al. ..... 15/210.1
2005/0115012 A1 * 6/2005 Wakat ..... 15/210.1
2006/0053574 A1 * 3/2006 Steinberg ..... 15/210.1

OTHER PUBLICATIONS

"Flexible." Meriam-Websters Online Dictionary. Jan. 23, 2013. <http://www.merriam-webster.com/dictionary/flexible>.*

(Continued)

*Primary Examiner* — Joseph J Hail
*Assistant Examiner* — Joel Crandall
(74) *Attorney, Agent, or Firm* — Jacobson and Johnson LLC; Thomas N. Phung

(57) ABSTRACT

The present invention comprises a crack and groove stain and paint tool and method of staining or painting a crack or groove with the crack and groove stain and paint tool comprising a handle, a flat blade attached to the handle and having a first face and a second face separated by an edge, and a backing fabric secured to the blade with the backing fabric having a stain or paint holding nap thereon with the backing fabric extending from the first face to the second face of the blade.

19 Claims, 2 Drawing Sheets

(56) References Cited

OTHER PUBLICATIONS

"Inflexible." Meriam-Websters Online Dictionary. Jan. 23, 2013. <http://www.merriam-webster.com/dictionary/inflexible>.*
"Stiff." Meriam-Websters Online Dictionary. Jan. 23, 2013. <http://www.merriam-webster.com/dictionary/stiff>.*
"Face." Meriam-Websters Online Dictionary. Jun. 13, 2013. <http://www.merriam-webster.com/dictionary/face>.*
"Junction." Meriam-Websters Online Dictionary. Jun. 13, 2013. <http://www.merriam-webster.com/dictionary/face>.*

* cited by examiner

STAIN AND PAINTING TOOL

CROSS REFERENCE TO RELATED APPLICATIONS

This application claims priority to U.S. Provisional Application Ser. No. 60/999,375; filed on Oct. 18, 2007; titled STAINING AND PAINTING TOOL.

FIELD OF THE INVENTION

This invention relates generally to staining or painting tools and, more specifically, to a crack and groove stain or paint tool that can be used to stain or paint sidewalls of cracks and grooves as well as exposed surfaces.

STATEMENT REGARDING FEDERALLY SPONSORED RESEARCH OR DEVELOPMENT

None

REFERENCE TO A MICROFICHE APPENDIX

None

BACKGROUND OF THE INVENTION

Applicator tools for painting and staining surfaces such as building walls, decks, fences, and siding are known in the art and generally comprise three types applicator tool, namely a standard paint brush applicator, a pad-based applicator and a roller-based applicator. Pad-based applicators and roller-based applicators are generally preferred as pad-based applicator and a roller-based applicator may include extensions to allow the user to apply the paint or stain to the floor surface at a faster rate compared to the use of the standard paint brush.

Although paint brush applicators, a pad-based applicators and a roller-based applicators work for their intended purpose, paint brush applicators, a pad-based applicators and roller-based applicators have various limitations in their use. One of the major limitation of the conventional paint brush applicators, a pad-based applicators and roller-based applicators is that it is often difficult for the conventional applicators to apply a coating of stain or paint to narrow or hard to reach surfaces such as between the cracks or grooves formed by the abutting vertical wall surfaces of the individual boards of the deck or fence or to wall surfaces that have been partially block or confine by a permanent fixture such as plumbing or heat piping. It is highly desirable that all exposed surfaces, especially those that are exposed to the outdoor environments such as decks and fences, be coated with stain or paint to protect the surfaces of environmental conditions.

The present invention solves the above-mentioned limitation by providing for a paint tool that includes a flat blade having a paint or stain supporting and distributing surface that is sized to reach the to hard to reach surfaces compared to the conventional applicators in order to complete a painting project.

SUMMARY OF THE INVENTION

Briefly, the present invention comprises a crack and groove stain and paint tool and method of staining or painting a crack or groove. The crack and groove stain and paint tool generally comprises a flat blade attached to a handle. The blade includes a first face and a second face separated by an edge. The crack and groove stain and paint tool includes a backing fabric secured to the first face and the second face of the blade. The backing fabric includes a stain or paint holding nap thereon with the backing fabric extending from the first face to the second face of the blade. The crack and groove stain and paint tool may include staples securing the backing fabric to the blade.

The method includes the steps of dipping a blade having a stain or paint holding pile fabric on opposite faces of the blade into a reservoir of paint to load stain or paint onto the pile fabric; inserting the blade with the stain or paint holding fabric into a crack or groove; contacting a wall of the crack or groove with the stain or paint holding fabric; and moving the blade with the stain or paint holding fabric longitudinally along the crack or groove to transfer stain or paint from the stain or paint holding fabric to at least one side of the crack.

DESCRIPTION OF THE PREFERRED EMBODIMENT

Figure 1:
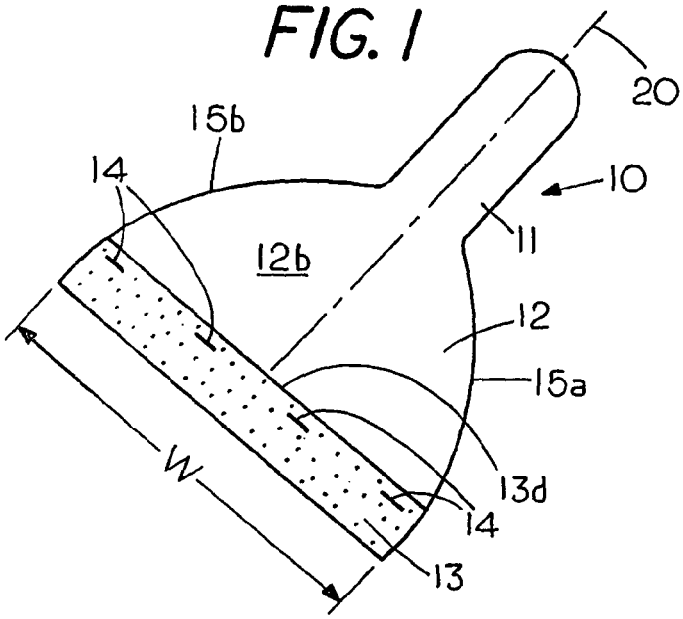
FIG. 1 is a perspective view of a crack and groove stain and paint tool.
Figure 2:
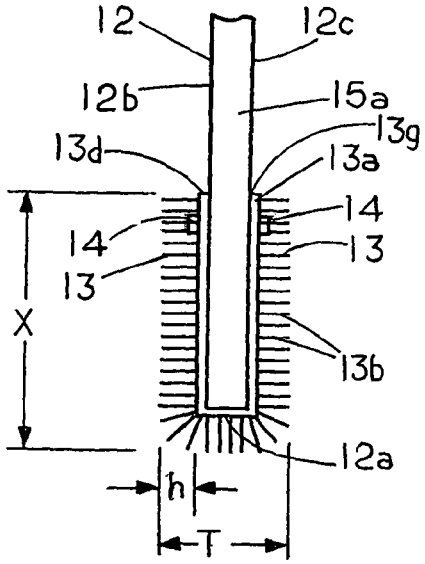
FIG. 2 is an enlarged side view of a portion of the crack and groove stain and paint tool of FIG. 1.
Figure 3:
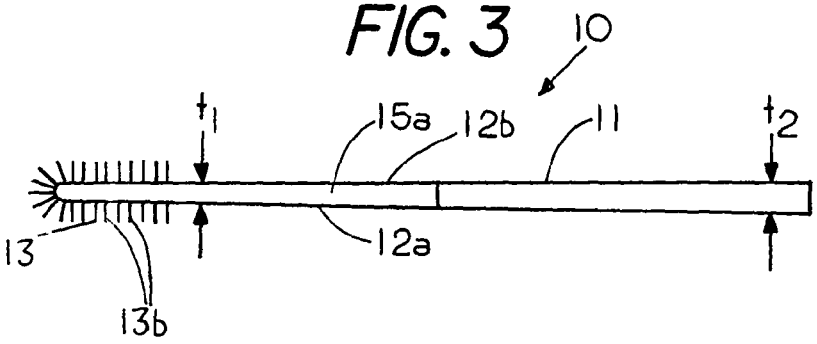
FIG. 3 is a side view of the crack and groove stain and paint tool of FIG. 1.

FIG. 1 is a perspective view of a crack and groove stain and paint tool 10 and FIG. 3 shows a side view of the crack and groove tool 10 with the tool 10 including a handle 11 and a flat blade 12 with the handle 11 and the blade 12 formed from a single piece of stiff but bendable polymer plastic. FIG. 2 shows an enlarged view of a portion of a side view of the blade 12 and a stain or paint holding pile fabric 13 located on opposites faces of blade 10. While the blade 12 and handle 11 are shown as integral in the embodiment of FIGS. 1 and 3, the handle and the blade could also be separate or the blade could also function as a handle or the handle could be made from a different material such as metal or wood.

Referring to the drawings, the handle 11 is shown having a contoured shape for gripping in a users hand while the half round flat blade 12 includes a substantially straight leading edge 12*a* that is located transverse to an axis 20 extending through handle 11 and blade 12. Located proximate the leading edge 12*a* is a pile fabric 13 having a backing fabric 13*a* with a stain or paint holding nap or fibers 13*b* that extend outward from the backing fabric 13*a*. The term nap refers to a raised pile or threads made during the weaving process that stands up from the surface of the fabric. Nap runs in one direction, reflecting light differently. The nap can be felt by running one's hand across the fabric. The nap can be distinguished in that if the fabric feels smooth and the pile lies flat it's with the nap. If the fabric "stands up" and feels rougher the fabric is then against the nap. Stain or paint holding pile fabric 13 is of the type used in conventional cylindrical stain or paint rollers or the like. Although the nap or fibers of the crack and groove stain and paint tool of the present invention can be formed from a variety of materials, the nap or fibers 13*b* shown in the embodiment of FIGS. 1, 2, and 3 preferably comprise flexibly resilient fibers that have the ability to flex and bend during use while returning back to their original shape after use. In addition, the nap or fibers 13*b* may also be constructed of a material that allows for the crack and groove tool 10 to be washed or clean for later use.

FIG. 1 and FIG. 2 show the pile fabric 13 comprising a one-piece backing fabric that is secured to the opposite faces 12*b* and 12*c* of blade 12 through the sole use of a set of fasteners comprising staples 14 although other methods of fastening such as adhesives or the like or a combination thereof can be used to secure the pile fabric 13 to the blade 12. The pile fabric 13 lays flat on both faces of blade 12 and extends a distance "x" along a first face 12*b* and a similar distance "x" along a second face 12*c* of blade 12. The pile fabric 13 also extends a distance "w" along a leading edge 12*a* of blade 12. It is noted that distance "w" may vary in size for the crack and groove tool of the present invention. For example distance "w" may comprise at least the width of a standard deck board or the width of a standard fence board.

Although FIGS. 1 and 2 show the pile fabric 13 as comprising a one-piece backing fabric that is secured to the opposite faces 12*b* and 12*c* of blade 12, alternative embodiments of the present invention may include separate backing fabrics independently secured to the opposite faces 12*b* and 12*c* of blade 12 or a backing fabric secured to just one of the faces 12*b* and 12*c* of the blade 12.

In the embodiment shown in FIG. 1 and FIG. 2 the pile fabric 13 comprises a single piece of pile fabric that extends along a portion of face 12*b*, over edge 12*a* and along a portion of face 12*a* to provide a paint holding region on both faces of blade 12. The stain or paint holding nap 13*b* extends outward an equal distance from the backing fabric 13*a* although in certain instance applications one may want to have the paint holding nap 13*b* of different height on each face of the blade 12. In addition one may want to have the stain or paint holding nap 13*b* extend different distance along the blade to provide different stain or paint carrying capacity on each face of the blade 12.

FIG. 2 shows the one-piece pile fabric 13 wrapped around the leading edge 12*a* of the blade 12 with the backing fabric end 13*d* and the backing fabric end 13*g* spaced substantially equal distance from the edge 12*a* of blade 12 with the ends 13*d* and 13*g* located substantially parallel to the edge 12*a* of blade 12. In the embodiment shown the pile fabric 13 extends at least 1 inch upward from edge 12*a* making it suitable for staining or painting cracks or grooves having a depth of less than 1 inch. If desired the length of the pile fabric 13 can be increased for use in staining or painting or staining deeper cracks or grooves and decreased if the stain and paint tool 10 is to be used with shallower cracks or grooves.

In addition, the individual fibers from the nap 13*b* also is shown extending from the backing fabric 13*a* in a direction substantially perpendicular to the backing fabric 13*a*. A feature of the present invention is that the individual fibers of the nap 13*b* each have the ability to individually flex and bend during use to compensate for cracks and grooves of varying width and return back to their original position or condition after use. For example, during use in the application of paint or stain to a surface of a groove or crack a portion of the fibers located on face 12*b* may bend or flex while the remaining fibers located on face 12*b* and face 12*c* may remain in their original position or condition or vice versa. All of the fibers alternatively may bend or flex or remain in their original position or condition during use in the application of paint or stain to the surface of the groove or crack.

FIG. 2 shows the pile fabric 13 has an uncompressed depth "h" and when wrapped around the blade 12 to provide a thickness "T". The thickness "T" is selected such that the pile fabric 13 in a compressed or uncompressed state can be inserted into a crack or groove to stain or paint the sidewall of the crack or groove. A suitable thickness "T" for most applications is about ½ inch or less with the nap 13*b* compressible to permit insertion of the end of the blade 12 and the stain or paint holding nap 13*b* into a crack or groove of ¼ inch or more.

Figure 4:
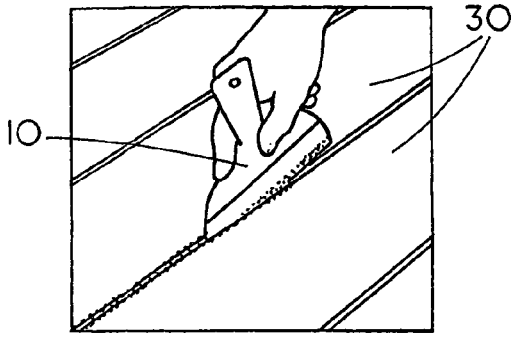
FIG. 4 shows the crack and groove stain and paint tool of FIG. 1 staining or painting sidewalls of a crack.

The crack and groove staining or painting tool 10 provides a multiple use tool as evidenced by the illustrations in FIGS. 4, 5, 6, 7, and 8 where FIG. 4 shows the crack and groove stain and paint tool 10 staining or painting sidewalls of a crack formed by boards 30.

Figure 5:
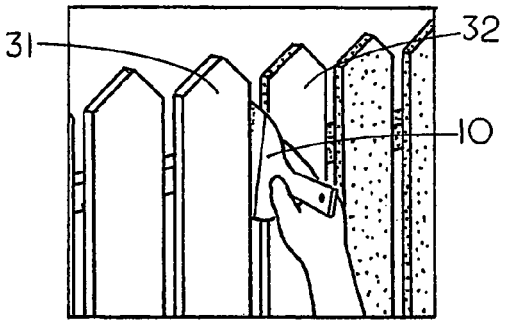
FIG. 5 shows the crack and groove stain and paint tool of FIG. 1 staining or painting an edge of a picket fence.
Figure 6:
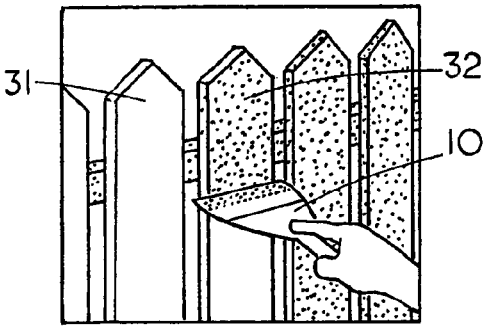
FIG. 6 shows the crack and groove stain and paint tool of FIG. 1 staining or painting an exposed surface of a picket fence.

FIG. 5 shows the crack and groove stain and paint tool 10 staining or painting an edge of a picket fence 31 and 32 and FIG. 6 shows the crack and groove stain and paint tool 10 staining or painting an exposed surface of a picket fence 32.

Figure 7:
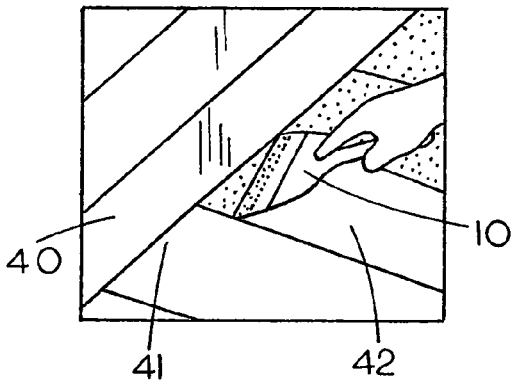
FIG. 7 shows the crack and groove stain and paint tool of FIG. 1 staining or painting a floor surface abutting a wall surface.
Figure 8:
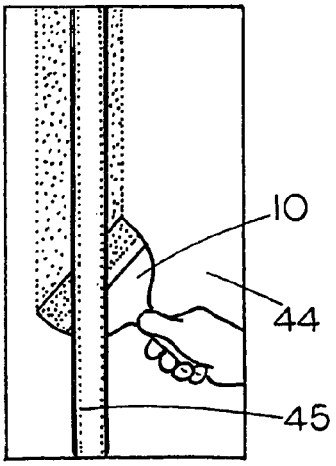
FIG. 8 shows the crack and groove stain and paint tool of FIG. 1 staining or painting behind a pipe located proximate a wall.

FIG. 7 shows the crack and groove stain and paint tool 10 staining or painting a floor surface 41, 42 abutting a vertical wall surface 40. FIG. 8 shows the crack and groove stain and paint tool 10 staining or painting behind a pipe 45 located in a slightly spaced condition from wall 44. Thus the invention includes but is not limited to the method of staining or painting a crack or groove comprising dipping a blade 12 having a paint holding pile fabric 13 on opposite faces of the blade into a reservoir of stain or paint to load stain or paint onto the pile fabric 13, inserting the blade with the stain or paint holding pile fabric 13 into a crack or groove; contacting a wall of the crack or groove with the stain or paint holding pile fabric 13 and moving the blade with the stain or paint holding pile fabric 13 longitudinally along the crack or groove to transfer stain or paint from the stain or paint holding pile fabric 13 to at least one sidewall of the crack.

The present invention also include a method of staining or painting a crack or groove comprising the steps of (1) dipping a blade 12 having a stain or paint holding pile fabric 13*b* on opposite faces 12*b* and 12*c* of the blade 12 into a reservoir of paint to load stain or paint onto the pile fabric 13*b*; (2) inserting the blade 12 with the stain or paint holding fabric 13*a* into a crack or groove; (3) contacting a wall 30, 41, 42 of the crack or groove with the stain or paint holding fabric 13*a*; and (4) moving the blade 12 with the stain or paint holding fabric 13*a* longitudinally along the crack or groove to transfer stain or paint from the stain or paint holding fabric 13*a* to at least one side of the crack.

The present invention also include a method of staining or painting up to an edge of a wall comprising the steps of: (1) dipping a blade 12 having a stain or paint holding pile fabric 13*b* on opposite faces 12*b*, 12*c* of the blade 12 into a reservoir of stain or paint to load stain or paint onto the pile fabric 13*b*; (2) contacting an exposed surface 44, 45 that abuts another with the stain or paint holding fabric 13*a*; and (3) moving the blade 12 with the stain or paint holding fabric 13*a* longitudinally along the exposed surfaces 44 of the groove to transfer stain or paint from the stain or paint holding fabric 13*a* to the exposed surface 44.

I claim:

1. A crack and groove stain and paint tool comprising:

a handle;

a stiff but flexible flat blade, said handle and said blade comprising a one piece member integrally formed from a single piece of stiff but bendable material, said blade and handle resiliently deflectable in response to a pressure on the handle, said blade having a first face and a second face separated by a substantially straight edge with said edge positioned transverse to said handle, said blade having a thickness that is thinner at the edge than at a junction with the handle;

a backing fabric directly secured to said blade and extending from a first surface area of said first face over said edge to a first surface area of said second face with the ends of the backing fabric running substantially parallel to the edge of the blade and extending at least an inch upward from the edge of the blade while leaving a second surface area of said first face and a second surface area of said second face of said blade free of backing fabric, said backing fabric having a stain or paint holding nap thereon, said nap comprising a plurality of flexibly resilient fibers that flex and bend during use and returns back to their original shape after use, said plurality of fibers each extending from the backing fabric in a direction substantially perpendicular to the backing fabric; and staples securing the backing fabric to the blade.

2. A crack and groove stain and paint tool comprising:

a handle;

a flat blade having a first face and a second face separated by an edge, said handle and said blade comprising a one piece member integrally formed from a single piece of material; and a backing fabric directly secured to a first surface area of said first face and a first surface area of said second face of said blade while leaving a second surface area of said first face and a second surface area of said second face of said blade free of backing fabric, said backing fabric having a stain or paint holding nap thereon.

3. The crack and groove stain and paint tool of claim 2 wherein the blade comprises a polymer plastic.

4. The crack and groove stain and paint tool of claim 2 wherein the edge is substantially straight and said backing fabric extends from said first face over said edge to said second face of said blade.

5. The crack and groove stain and paint tool of claim 2 including staples securing the backing fabric to the blade.

6. The crack and groove stain and paint tool of claim 2 wherein the edge of said blade is positioned transverse to said handle.

7. The crack and groove stain and paint tool of claim 2 wherein the backing fabric having a stain or paint holding nap comprises a one-piece backing fabric.

8. The crack and groove stain and paint tool of claim 2 wherein the stain or paint holding nap comprises a plurality of flexibly resilient fibers that flex and bend during use and returns back to their original shape after use.

9. The crack and groove stain and paint tool of claim 2 wherein the stain or paint holding nap comprising a plurality of fibers each extending from the backing fabric in a direction substantially perpendicular to the backing fabric.

10. The crack and groove stain and paint tool of claim 2 wherein the backing fabric having a stain or paint holding nap extends partially onto opposite faces of said blade.

11. The crack and groove stain and paint tool of claim 2 wherein the backing fabric having a stain or paint holding nap extends an equal distance on opposite faces of said blade.

12. The crack and groove stain and paint tool of claim 2 wherein the stain or paint holding nap comprises a plurality of flexibly resilient fibers having varying lengths to apply paint or stain to cracks of varying width.

13. The crack and groove stain and paint tool of claim 2 wherein an end of the backing fabric extends substantially parallel to the edge of the blade.

14. The crack and groove stain and paint tool of claim 2 wherein the blade and handle resiliently deflect in response to a pressure on the handle.

15. The crack and groove stain and paint tool of claim 2 wherein the thickness of the blade at the edge is thinner then the thickness of the blade at a junction with the handle.

16. The crack and groove stain and paint tool of claim 2 wherein the backing fabric on the first face and the backing fabric on the second face extends at least an inch upward from the edge of the blade.

17. The crack and groove stain and paint tool of claim 2 wherein the thickness "T" of the tool is less than one inch in an uncompressed condition with the stain or paint holding nap compressible to permit insertion in a crack or groove.

18. The crack and groove stain and paint tool of claim 2 wherein the blade is stiff but permits flexing of the blade as pressure is applied to the handle.

19. The crack and groove stain and paint tool of claim 2 wherein the sole means of holding the pile fabric on the blade comprises a set of staples extending through the blade and the pile fabric.

* * * * *